US005216850A

United States Patent [19]

Kemper et al.

[11] Patent Number: 5,216,850

[45] Date of Patent: Jun. 8, 1993

[54] PORTABLE GARAGE APPARATUS

[76] Inventors: Thomas S. Kemper; Evelyn L. Kemper, both of 10021 Bonazzi, Houston, Tex. 77088

[21] Appl. No.: 641,458

[22] Filed: Jan. 14, 1991

[51] Int. Cl.[5] ..... E04B 1/345

[52] U.S. Cl. ..... 52/2.11

[58] Field of Search ..... 52/2.11, 2.17; 135/115, 135/87, 114; 15/217

[56] References Cited

U.S. PATENT DOCUMENTS

| | | | |
|---|---|---|---|
| 1,288,518 | 12/1918 | Collier | 135/114 |
| 1,699,094 | 1/1929 | Chadirjian et al. | 135/87 |
| 2,196,544 | 4/1940 | Bagley | 135/87 |
| 2,420,706 | 5/1947 | Haven et al. | 135/115 |
| 2,516,869 | 8/1950 | Harris | 135/115 |
| 2,847,017 | 8/1958 | Drago | 135/115 |
| 2,928,405 | 3/1960 | Lawson | 135/87 |
| 3,805,816 | 4/1974 | Nolte | 135/115 |
| 4,000,585 | 1/1977 | Denaro | 52/2.17 |
| 4,012,867 | 3/1977 | Lainchbury et al. | 52/2.17 |
| 4,887,627 | 12/1989 | Audet | 135/87 |

FOREIGN PATENT DOCUMENTS

| | | | |
|---|---|---|---|
| 700282 | 12/1964 | Canada | 52/2.17 |
| 891603 | 11/1952 | Fed. Rep. of Germany | 135/87 |
| 2421244 | 11/1975 | Fed. Rep. of Germany | 52/2.11 |
| 5184 | of 1902 | United Kingdom | 135/87 |
| 1546752 | 5/1979 | United Kingdom | 52/2.11 |

*Primary Examiner*—David A. Scherbel
*Assistant Examiner*—Michele A. Van Patten
*Attorney, Agent, or Firm*—Leon Gilden

[57] ABSTRACT

An apparatus wherein flexible panel webs are secured to a carport structure, wherein the carport structure includes a plurality of support posts mounting a roof thereon. The flexible webs are mounted utilizing snap fasteners to post mounts that are in turn mounted to the support posts.

4 Claims, 4 Drawing Sheets

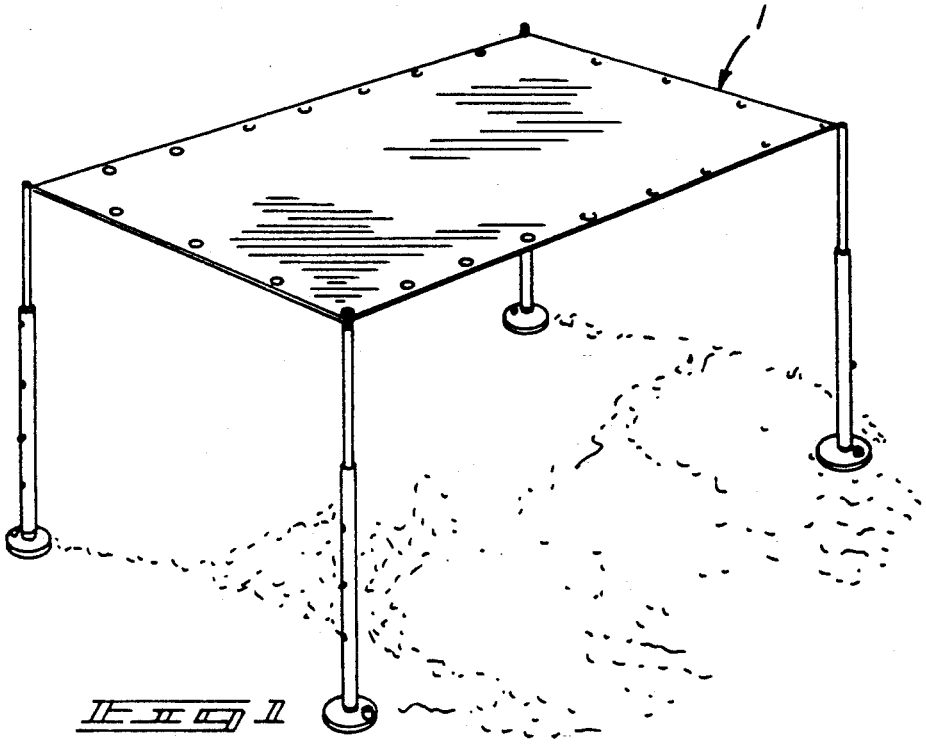
FIG 1
PRIOR ART
FIG 2
PRIOR ART
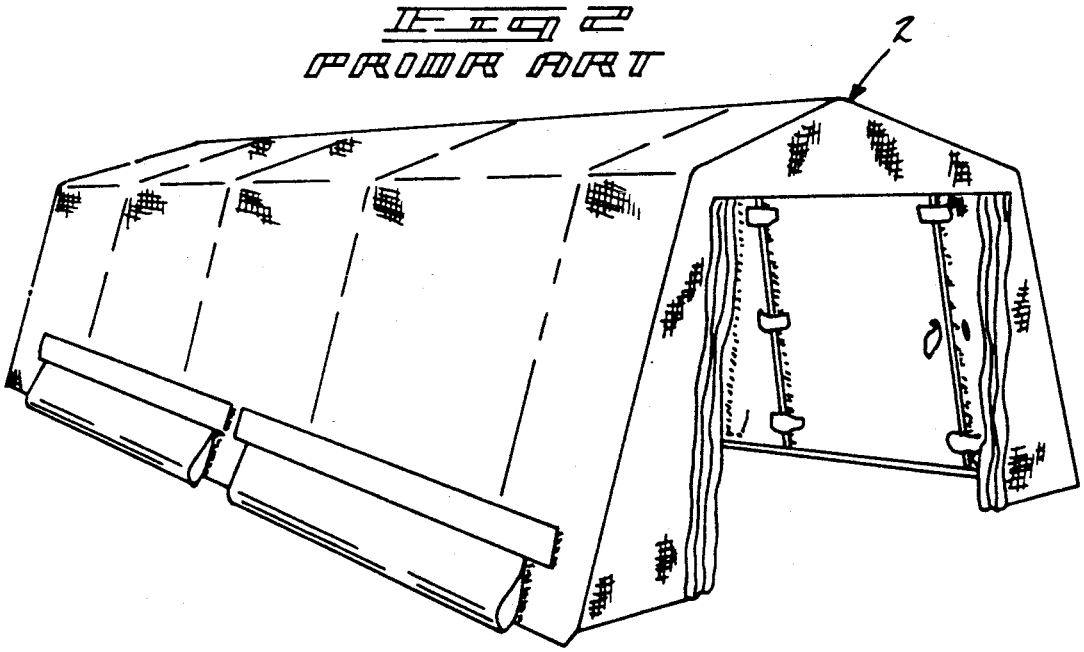

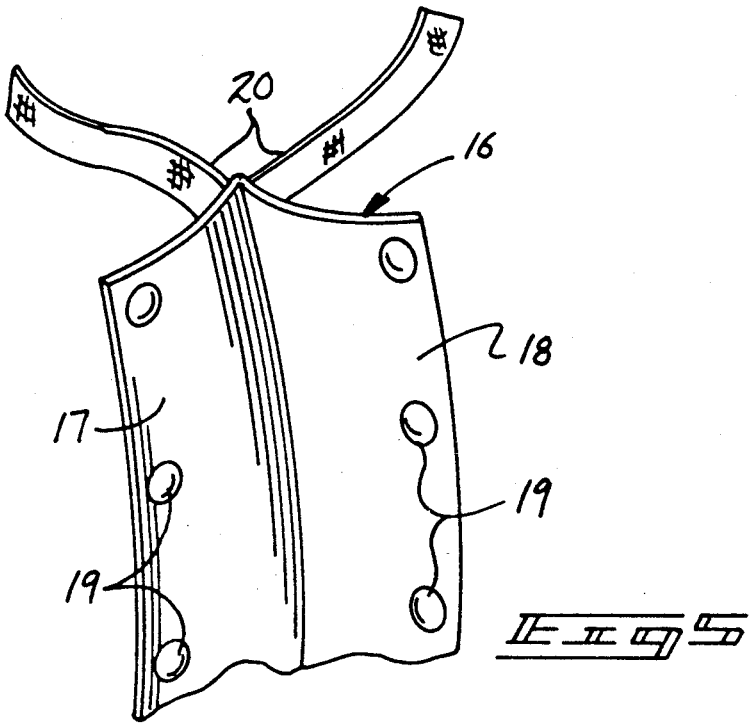
Fig 5
Fig 6
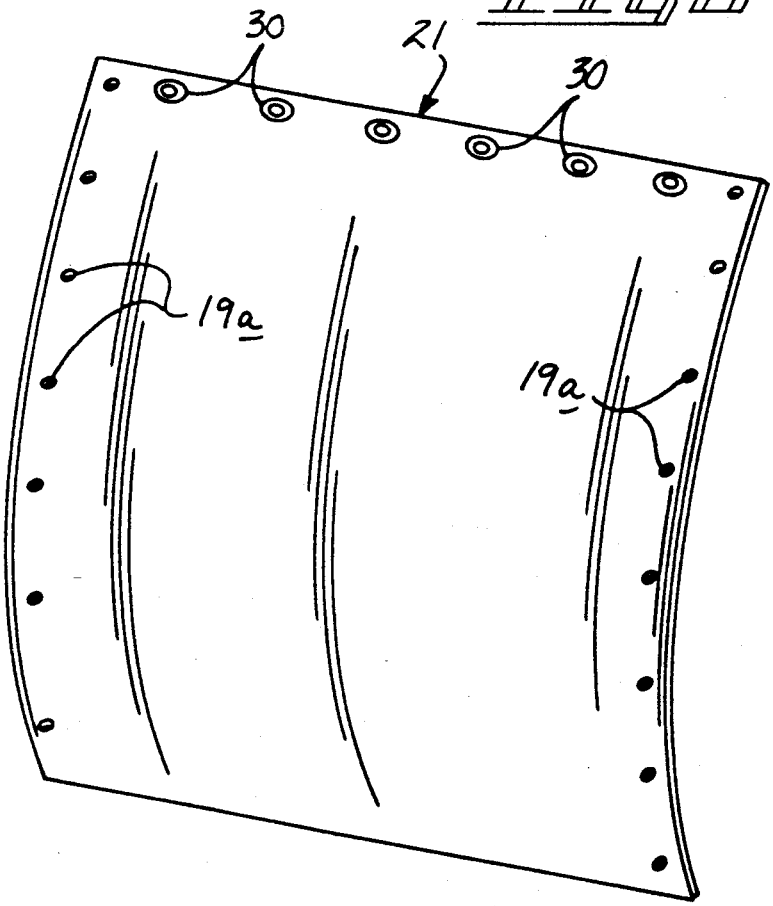

PORTABLE GARAGE APPARATUS

BACKGROUND OF THE INVENTION

1. Field of the Invention

The field of invention relates to portable garage structure, and more particularly pertains to a new and improved portable garage apparatus wherein the same mounts an existing carport structure to provide an enclosed garage for housing vehicles and the like therein.

2. Description of the Prior Art

Various portable garage apparatus has been utilized in the prior art. Such apparatus requires self-supporting organizations to house various structure therewithin. For example, U.S. Pat. No. 2,928,405 to Lawson sets forth a portable shelter structure, wherein telescoping posts mount a flexible web therebetween to provide a roof structure.

U.S. Pat. No. 4,887,627 to Audet sets forth a shelter of a tent-like configuration.

U.S. Pat. No. 2,880,741 to McGrand sets forth a portable hanger wherein a tether line construction supports panels therefrom to provide a shelter organization.

U.S. Pat. No. 2,995,137 to Cothern sets forth a rain shelter structure to overlie portions of an automobile utilizing a flexible web mounted to various structural components of the automobile.

U.S. Pat. No. 3,050,074 to Miller sets forth a vehicle tent mounted to a roof structure of an automobile, wherein the tent structure is arranged for extension for mounting a tent structure overlying the vehicle.

As such, it may be appreciated that there is a continuing need for a new and improved portable garage apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of portable garage apparatus now present in the prior art, the present invention provides a portable garage apparatus wherein the same is arranged for retrofit to existing carport structure. As such, the general purpose of the present invention, which will be described subsequently in greater detail, is to provide a new and improved portable garage apparatus which has all the advantages of the prior art portable garage apparatus and none of the disadvantages.

To attain this, the present invention provides an apparatus wherein flexible panel webs are secured to a carport structure, wherein the carport structure includes a plurality of support posts mounting a roof thereon. The flexible webs are mounted utilizing snap fasteners to post mounts that are in turn mounted to the support posts.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable garage apparatus which has all the advantages of the prior art portable garage apparatus and none of the disadvantages.

It is another object of the present invention to provide a new and improved portable garage apparatus which may be easily and efficiently manufactured and marketed.

It is a further object of the present invention to provide a new and improved portable garage apparatus which is of a durable and reliable construction.

An even further object of the present invention is to provide a new and improved portable garage apparatus which is susceptible of a low cost of manufacture with regard to both materials and labor, and which accordingly is then susceptible of low prices of sale to the consuming public, thereby making such portable garage apparatus economically available to the buying public.

Still yet another object of the present invention is to provide a new and improved portable garage apparatus which provides in the apparatuses and methods of the prior art some of the advantages thereof, while simultaneously overcoming some of the disadvantages normally associated therewith.

Still another object of the present invention is to provide a new and improved portable garage apparatus wherein the same utilizes flexible webs for securement coextensively between support posts of an existing carport structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art portable shelter structure.

FIG. 2 is an isometric illustration of a further example of a prior art shelter structure.

FIG. 5 is an enlarged isometric illustration of the post mount utilized by the instant invention.

FIG. 6 is an isometric illustration of a door flap utilized by the instant invention.

DESCRIPTION OF THE PREFERRED EMBODIMENT

Figure 3:
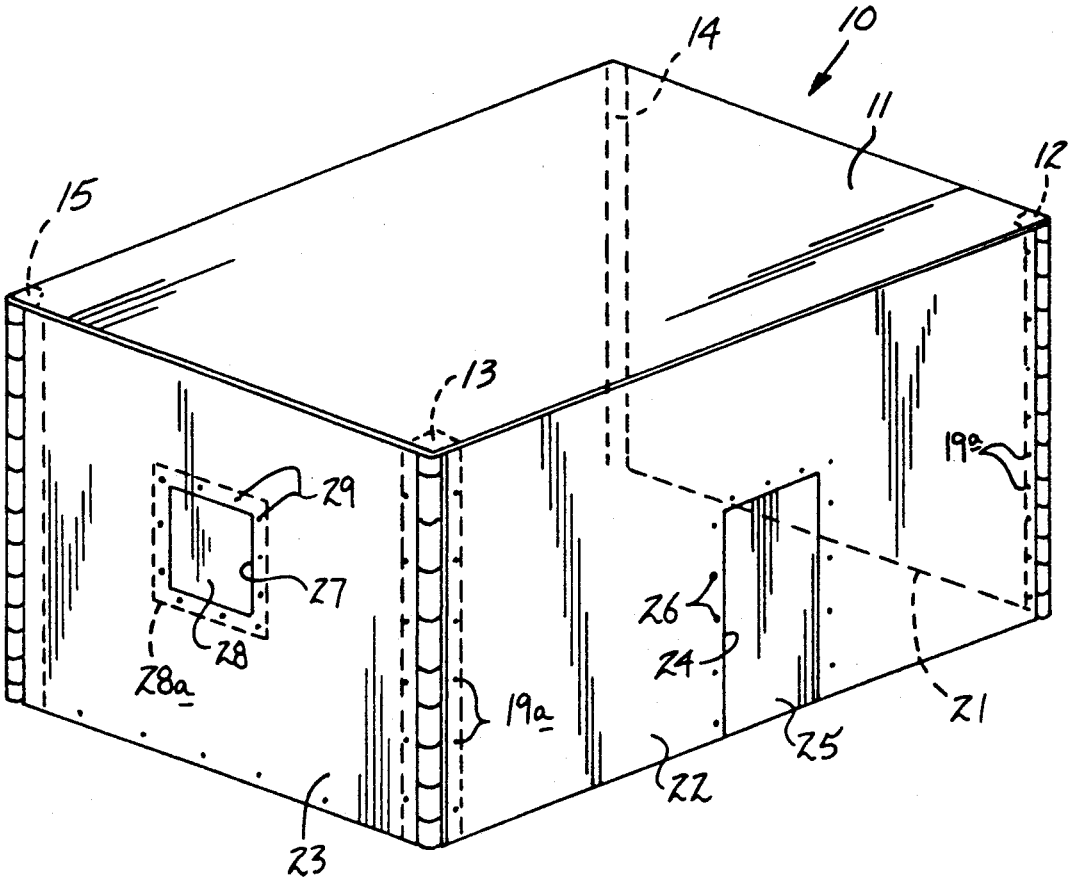
FIG. 3 is an isometric illustration of the instant invention.
Figure 4:
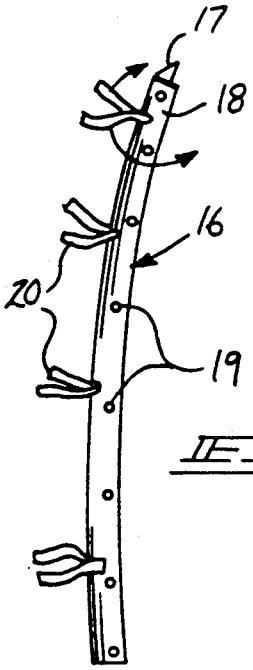
FIG. 4 is an isometric illustration of one of a plurality of posts mounts for securement of each post of the existing carport.

With reference now to the drawings, and in particular to FIGS. 1 to 9 thereof, a new and improved portable garage apparatus embodying the principles and concepts of the present invention and generally designated by the reference numeral 10 will be described.

FIG. 1 illustrates a prior art portable shelter structure 1, in a manner as set forth in U.S. Pat. No. 2,928,405, wherein telescoping poles mount an overlying flexible web coextensively therebetween. FIG. 2 illustrates a further example of a prior art shelter, as set forth in U.S. Pat. No. 4,887,627, formed as a tent-like structure, as well as including flaps arranged adjacent a lower perimeter of the shelter to minimize passage of air underneath side walls or floor of the shelter.

More specifically, the portable garage apparatus 10 of the instant invention essentially comprises cooperation with an existing carport structure that includes a carport roof 11 supported by first forward post 12 and a rear post 13, with a second forward post 14 and a second rear post 15 defining the forward and rear pairs of support posts in the carport structure. The garage apparatus further includes a post mount structure 16 (see FIGS. 4 and 5) that is defined by a first and second flap 17 and 18 joined at a seam, wherein the first and second flaps 17 and 18 include a series of equally spaced snap fasteners 19 mounted apart a predetermined spacing along each first and second flap 17 and 18 coextensively therewith. Plural pairs of securement straps 20 are mounted adjacent the apex or joinder seam of the first and second flaps 17 and 18, with the plural pairs of securement straps utilizing hook and loop fastener portions to secure the straps about an associated support post. A post mount 16 is secured about each support post for securement of associated panels to the support post. The panels include an entrance to a panel 21, a rear wall panel 23, and a side wall panel 22, wherein the side wall panel is extended between the first forward and rear posts 12 and 13, with the rear panel 21 extended between the first and second forward post 14 and the rear wall panels 21 and 23 extending between the first and second rear posts. Each of the panels include further snap fasteners 19*a* for securement of the panels to the snap fasteners 19 of each post mount 16. Accordingly, the entrance and side wall panels 22 respectively are of a predetermined length substantially equal to a post spacing between the pairs of forward posts and rear posts, as illustrated. The side wall panel 22 is of a side wall panel length substantially equal to a further predetermined length between the first forward post 12 and the first rear post 13. The side wall panel 22 includes a side wall opening 24 mounting the side wall door 25 thereto utilizing side wall snap fasteners 26 to mount the side wall door 25 within the side wall opening 24. Similarly, a rear wall opening 27 is formed through the rear wall panel 23 utilizing a rear wall cover 28 complementarily received within the rear wall opening 27 and utilizing rear wall cover snap fasteners 29 to mount the rear wall cover 28 within the rear wall panel 23.

FIG. 6 illustrates the entrance panel 21, including reinforcing grommet openings 30 formed coextensively along an upper edge of the entrance panel 21 for receiving fasteners therethrough for mounting the entrance panel to the carport roof for an underlying framework. The further snap fasteners 19*a* formed coextensively along each vertical edge of the entrance panel 21 to permit securement of the entrance panel to associated snap fasteners 19 of post mounts 16 mounted to the first and second forward post 12 and 14. It is noted that the snap fasteners 19*a* are also spaced apart the predetermined spacing as the snap fasteners 19.

Figure 7:
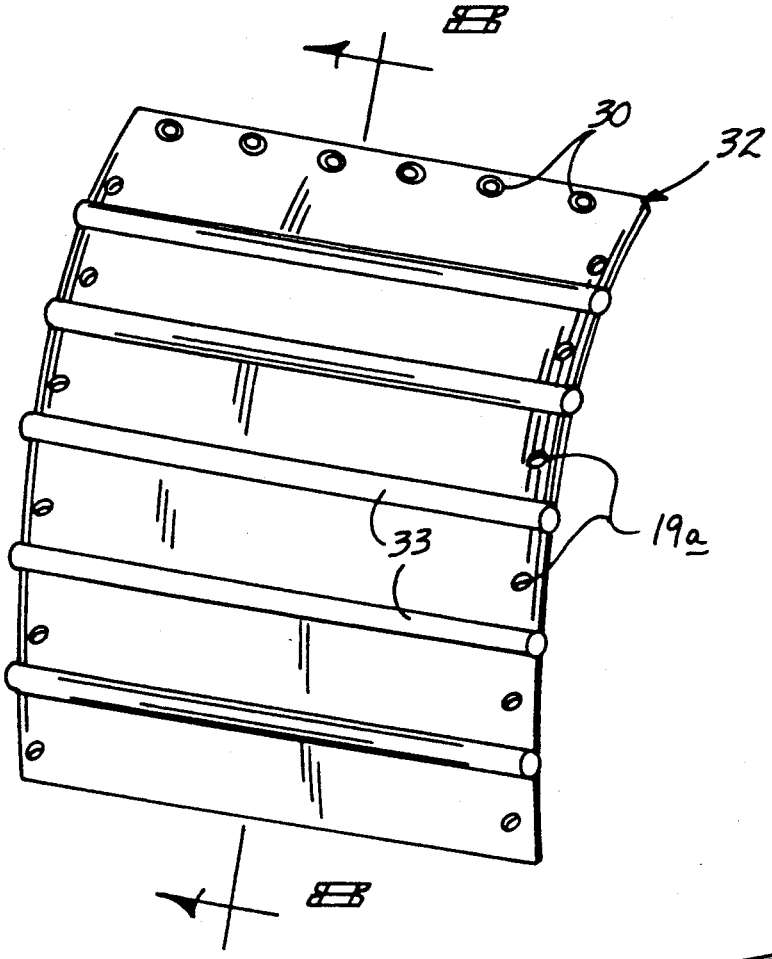
FIG. 7 is an isometric illustration of a modified door flap utilized by the instant invention.
Figure 8:
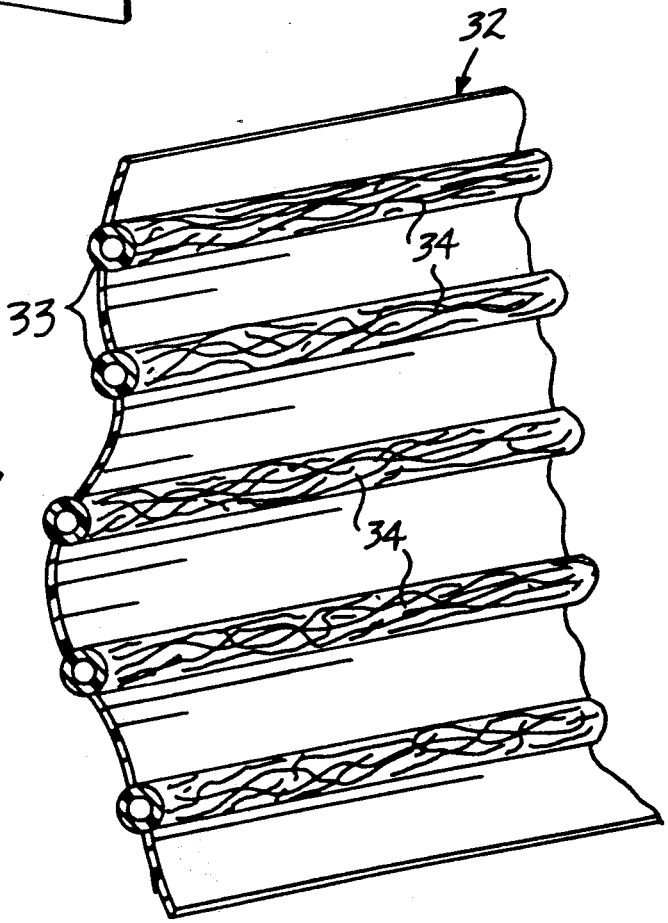
FIG. 8 is an orthographic view, taken along the lines 8—8 of FIG. 7 in the direction indicated by the arrows.

FIGS. 7 and 8 illustrate the use of a modified entrance door panel 32, wherein pneumatic tubes 33 are directed laterally at equal spacings along the entrance door panel 32. The pneumatic tubes 33 include bristle brush coverings 34 formed coextensively of each exterior surface of each tube 33, whereupon a vehicle directed through the entrance door panel 32 when the panels further snap fasteners 19*a* are released relative to each respective post mount 16 permits the door to remove excess debris relative to the vehicle directed therethrough when the vehicle is directed along the flexible web during its traverse into the carport.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable garage apparatus comprising, in combination, a first forward post spaced from a second forward post a predetermined first spacing, and a first rear post spaced from a second rear post the predetermined first spacing, and the first forward post spaced from the first rear post a predetermined second spacing and the second forward post spaced from the second rear post the predetermined second spacing, and a roof mounted overlying the posts, and a flexible side wall panel of a predetermined length equal to the predetermined second spacing mounted coextensively between the first forward post and the first rear post, and a flexible rear wall panel mounted between the second forward post and the second rear post, wherein the rear wall panel is defined by a rear wall panel length equal to the predetermined first spacing, and a flexible entrance door panel removably mounted overlying the first forward post and the second forward post, wherein the entrance door panel is defined by an entrance door panel length substantially equal to the predetermined first spacing, and a post mount secured to each post, each post mount including a first flap and a second flap, wherein the first flap and second flaps are secured together at an elongate seam, with plural pairs of securement straps mounted along the seam of each post mount, wherein each securement strap of the plural pairs of securement straps include hook and loop fasteners for securing each of the plural pairs of securement straps about each post, and the first and second flaps each include snap fasteners spaced apart a predetermined spacing mounted to each of the first and second flaps coextensively thereof, and the side wall panel, rear wall panel, and entrance door panel include further snap fasteners mounted coextensively of each side edge of each panel, and the further snap fasteners are spaced apart the predetermined spacing for securement of the further snap fasteners to the snap fasteners.

2. An apparatus as set forth in claim 1 wherein the entrance door panel includes a plurality of reinforcing grommet openings formed coextensively of an upper edge of the entrance door panel for securement of the upper edge adjacent the roof.

3. An apparatus as set forth in claim 2 wherein the side wall panel includes a side wall opening, and a side wall door removably mounted coextensively within the side wall opening, and the rear wall includes a window opening, and a window panel complementarily received within the window opening for selective securement thereto.

4. An apparatus as set forth in claim 3 wherein the entrance door panel includes a plurality of pneumatic tubes orthogonally mounted between opposed sides of the entrance door panel, and each pneumatic tube includes a bristle brush covering formed coextensively overlying each exterior surface of each pneumatic tube.

* * * * *